United States Patent [19]

Mama et al.

[11] 4,120,342

[45] Oct. 17, 1978

[54] AIRCRAFT HANGER DOOR

[75] Inventors: Kelly D. Mama, Mount Prospect; Otto C. Roller, Chicago, both of Ill.

[73] Assignee: Channon Corporation, Chicago, Ill.

[21] Appl. No.: 751,809

[22] Filed: Dec. 17, 1976

[51] Int. Cl.[2] ..... A47G 5/02; E06B 9/20

[52] U.S. Cl. ..... 160/310; 160/243

[58] Field of Search ..... 160/243, 310

[56] References Cited

U.S. PATENT DOCUMENTS

| | | | |
|---|---|---|---|
| 3,398,779 | 8/1968 | Kuss | 160/243 |
| 3,521,693 | 7/1970 | Kuss | 160/243 |
| 3,537,504 | 11/1970 | Deane | 160/243 |
| 3,704,742 | 12/1972 | Kuss | 160/243 |

*Primary Examiner*—Peter M. Caun

*Attorney, Agent, or Firm*—Hill, Gross, Simpson, Van Santen, Steadman, Chiara & Simpson

[57] ABSTRACT

A closure for an opening in an aircraft hanger includes a curtain having its top marginal edge connected to the header of the opening and its bottom marginal edge connected to and taken up on and paid out from an elongate tube. The marginal side edges of the curtain overlap the side walls which define the opening. A vertical track is supported adjacent the side marginal edges of the curtain and rollingly support respective tube guides moving therealong in a vertical direction. The tube guides are connected to the tube at one end by a rotational journal therewith and at the other end by a fixed shaft of a fluid motor which has the motor proper, or a gear reducing mechanism therefor, mounted within and connected to the interior wall of the tube. The fluid motor is reversible so as to rotate the tube to take up and pay out the curtain, the tube and tube guide following the curtain up and down along the vertical track. Side seals are provided to clamp the side marginal edges to the respective side walls when the curtain is in the closed position and are mounted to swing out of the way so that the curtain may be raised to provide aircraft movement through the opening.

11 Claims, 8 Drawing Figures

62
60
536
530
522
532
444
466
534
538
528
526
524
446
468
M
506
548
502
550
540
503
516
520
518
504
505
542
514
448
508
510
506
512
PILOT AND DUMP LINES 482
484
480
470
474
M
472
FILTER
478
476
500
492
498
464
488
490
356
491
432
486
494
PILOT LINES

AIRCRAFT HANGER DOOR

BACKGROUND OF THE INVENTION

1. Field of the Invention

This invention relates to closures, and is more particularly concerned with closures for large openings such as provided in aircraft hangers.

2. Description of the Prior Art

In U.S. Pat. No. 3,211,211 Wilbur Youngs discloses a closure for an aircraft hanger in which an elongate tube is connected to the bottom marginal edge of and takes up and pays out a curtain which has its top marginal edge connected to a header of the opening. An electric motor, with a gear reduction unit, coacts between at least one end of the tube and a side wall of the opening to cause rotation of the tube and take up and pay out of the curtain.

Other mechanisms are well known in the art, particularly in the art of stage curtains and the like, wherein electric motor mechanisms are mounted within a tube connected to the bottom marginal edge of a curtain.

There is a multitude of other art concerned with the sealing of bottom and side marginal edges of a curtain which is lowered to a closed position. These devices, however, usually involve manually operated closing and locking mechanisms.

SUMMARY OF THE INVENTION

It is the primary object of the invention to provide a closure of the type described above which has a number of positive safety features not found in arrangements disclosed in the prior art.

A more particular object of the invention is to provide a closure of the type initially mentioned in which the power unit is basically a fluid control mechanism and which is easily, simply and readily provided with safety mechanisms which prevent inadvertent lowering of the curtain so as to endanger aircraft and operating personal.

According to the invention a closure, in particular an aircraft hanger door comprises a curtain which has a top marginal edge connected to the door header and its side marginal edges overlapping respective sides of the doorway. An elongate tube is connected to the bottom marginal edge of the curtain and is rotated about its longitudinal axis to take up and pay out the curtain, the tube and wound curtain traveling vertically along a pair of vertical guides supported adjacent the outboard ends of the tube. The prime mover for the tube comprises a reversible fluid motor mounted within the tube with one motor part connected to the interior of the tube and another motor part connected to a guide member which travels along one of the vertical guides.

A particular feature of the invention resides in the provision of a torque resistance mechanism for retarding unwinding of the curtain when the tube is not being driven in either direction and when the tube is not being braked. The torque resistance mechanism may advantageously be constructed as a plate which carries at least two rollers which are diametrically located with respect to the axis of rotation of the tube and which embrace and bear against opposite edges of a vertical guide. The vertical guide may be constructed so as to include an I-beam and the rollers are positioned to engage opposite edges of a horizontal bar of the I.

Another feature of the invention resides in the provision of a hydraulically operated parallelogram seal structure by which the side marginal edges of the fabric are sealed against the marginal edges of the door opening, a resilient material such as rubber, synthetic sponge, styrofoam or the like being carried by the marginal edges of the door opening to ensure complete sealing along the full extent of the seal structure.

Another advantageous feature of the invention resides in the provision of a hold-down structure which is carried by the parallelogram seal structure to engage and hold down the tube when the door is in its lowered position.

Advantageously, the floor may support an elongate hollow resilient bottom seal which receives the tube thereon in a condition clamped down by the hold-down structure.

BRIEF DESCRIPTION OF THE DRAWINGS

Other objects, features and advantages of the invention, together with its organization, construction and operation will be best understood from the following detailed description taken in conjunction with the accompanying drawings, on which.

DESCRIPTION OF THE PREFERRED EMBODIMENTS

Figure 1:
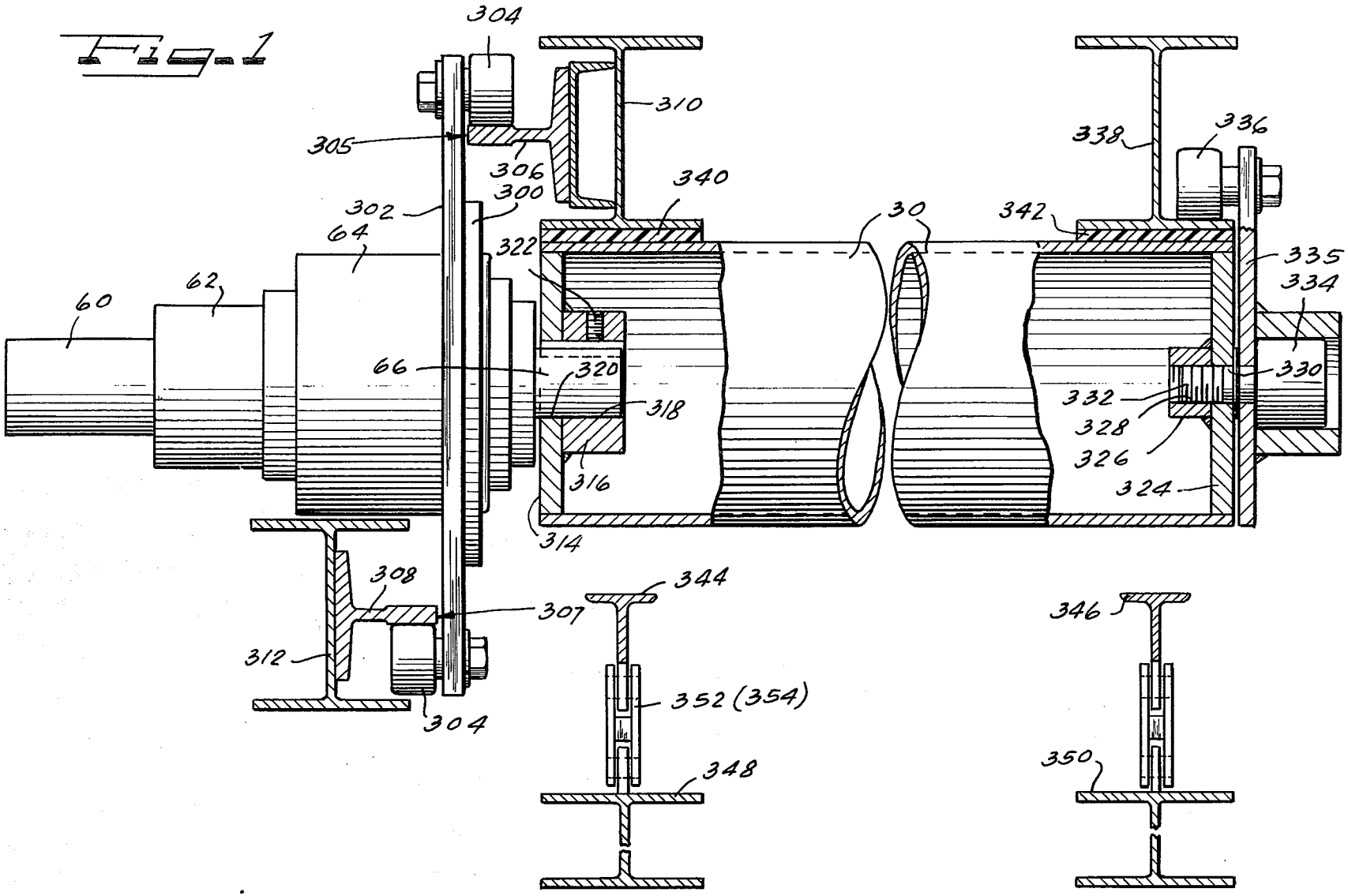
FIG. 1 is a top view, shown partially in section, of an embodiment of the invention in which the drive motor is mounted outside of the tube, and showing a side seal mechanism.
Figure 4:
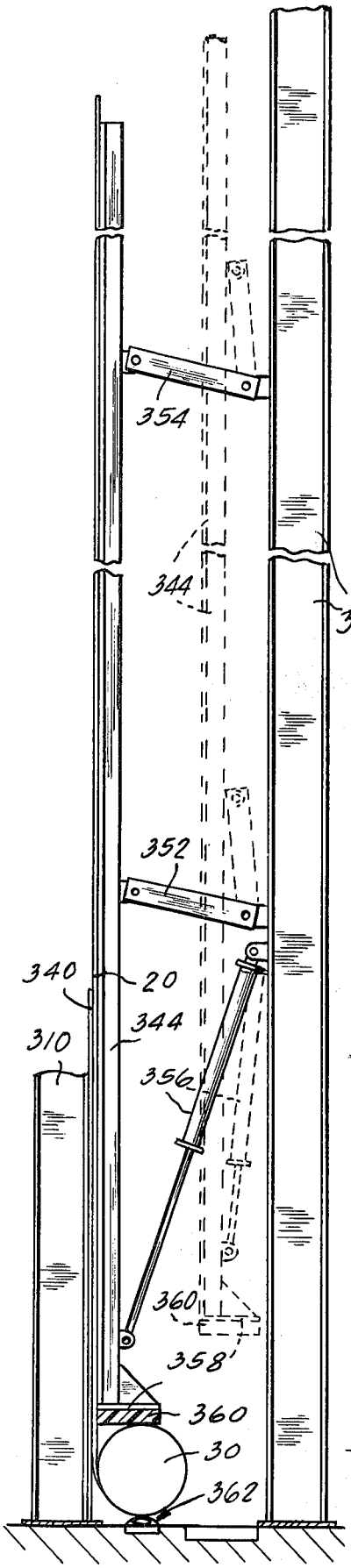
FIG. 4 is elevational view of a side seal mechanism of the type illustrated in FIG. 1.
Figure 2:
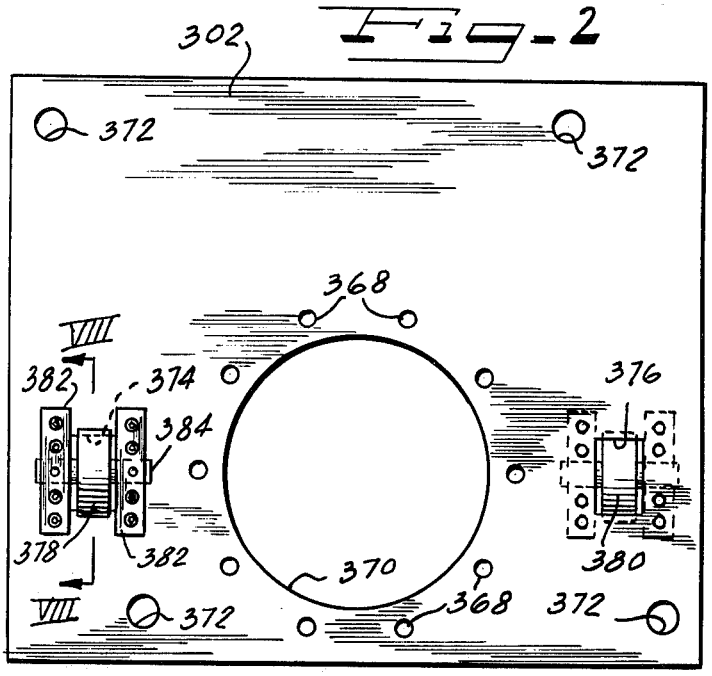
FIG. 2 is a plan view of a guide plate showing the mounting of guide rollers.
Figure 3:
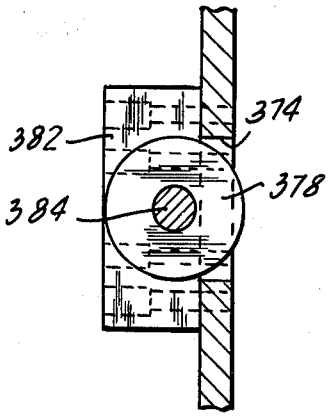
FIG. 3 is a sectional view of a portion of the apparatus of FIG. 2 taken substantially along the line VIII—VIII.
Figure 5:
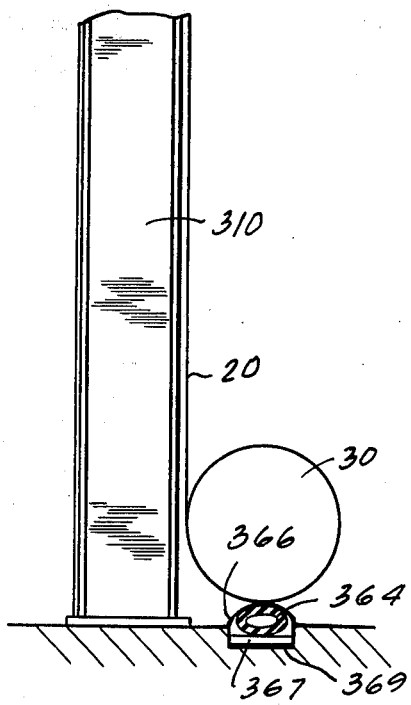
FIG. 5 is an enlarged view of a bottom seal.

Referring now to FIGS. 1–5, an embodiment of the invention is illustrated, an embodiment which we prefer, in which the fluid motor 60, the fluid brake 62 and the gear reduction unit 64 are mounted outside of the tube 30, the tube 30 wound thereabout as indicated in FIGS. 4 and 5. The gear reduction unit 64 includes a radially extending flange 300 which is secured to a plate 302 which is a part of the guide means. The plate 302 carries a plurality of rollers 304 which rollingly engage opposite sides of a pair of T-beams 306 and 308. This relationship and staggering of the rollers 304 will be appreciated from the illustration of FIG. 2 in which a plurality of holes 372 are illustrated as being staggered, the holes 372 mounting the axles of the rollers 304. Also FIG. 2 illustrates that the plate 302 includes an aperture 370 which has circumferentially spaced holes 368 thereabout for mounting the flange 300 of the gear reduction unit 64 to the plate 302.

Although not illustrated in FIG. 1, the plate 302 also carries a pair of rollers 378 and 380 which extend through respective apertures 374 and 376 (see FIG. 3) and which have their axles suitably mounted to the plate 302 so that the same bear against the ends of the T-beams 306 and 308, as indicated by the arrows 305 and 307.

The T-beams 306 and 308 are mounted to respective vertically extending H-beams or I-beams 310 and 312, the securement therebetween being by means of bolts, welding or the like. At the opposite end of the tube 30 there is provided another H-beam or I-beam 338 which acts as a vertical guide for a roller or rollers 336 carried by a plate 335.

For rotational connection of the tube 30, the gear reduction unit 64 has an output shaft 66 which extends through an aperture 320 in an end plate 314 of the tube 30, and further through an aperture 318 of a collar 316 which is connected to the end plate 314, such as by welding. A set screw 322, or other suitable means secures the collar, and hence the tube 30, to the shaft 66. At the other end of the tube 30, an end plate 324 has a collar 326 secured thereto, such as by welding. The end plate 324 includes an aperture 330 which is aligned with an aperture 328, perhaps a threaded aperture, to receive a shaft 332 which has its other end mounted in a bearing 334 which is carried by the plate 335. Therefore, as the motor 60 operates, the gear reduction unit is secured against rotation and causes rotation of the tube 30 by means of the journaling supplied at one end by the gear reduction unit and at the other end by the bearing 334.

The beams 310 and 338 may advantageously form the marginal edges of the side walls of the door opening. In order to seal the curtain against these marginal edges, the beams 310 and 338 each carry a respective resilient member 340, 342 of a resilient material, such as neoprene or styrofoam, and a pair of side seal mechanisms, including a pair of members 344 and 346 press the side marginal edges of the curtain against the members 340, 342, hereinafter called pads. As seen in FIG. 1, the member 344 is pivotally connected to a respective vertical beam 348, 350, such as by means of the pivotal links 352, 354.

The side seal mechanism is best seen in FIG. 4 in which one of the side seal mechanisms is illustrated as comprising a vertically extending beam 348 and a vertically extending beam 344 which is parallel thereto and remains parallel thereto in the form of a parallelogram, notwithstanding the distance therebetween. As illustrated in FIG. 9 the beam 344 is pivoted on a pair of links 352 and 354 to a position where it presses the curtain 20 against the pad 340 carried by the beam 310. This pivotal movement is accomplished by actuating a hydraulic cylinder 356. Operation of the cylinder in the opposite direction, of course, moves the beam 344 into a position whereby the seals are opened and the beam 344 is out of the up-down path of travel of the tube 30.

Referring to the lower portion of FIG. 9, the beam 344, and of course the beam 346, (FIG. 1) carries a horizontal member 358 which, in turn, carries a similar sealing pad 360 which engages and holds down the end of the tube 30 when the door is closed and the seal is effective. This leaves the floor area of the opening free of obstructions as found in hold-down devices of others which extend above the floor and are subject to damage, or damage to entering and departing aircraft. In the hold-down position, the tube 30 rests upon a bottom seal 362 which, as best seen in FIG. 10, may comprise a somewhat flattened neoprene tube 364 which is covered by a material, such as a wear-resistant vinyl fabric, which is secured to a block 367, the entire seal being disposed in a shallow trough 369 which extends at least the length of the tube 30.

Figure 6:
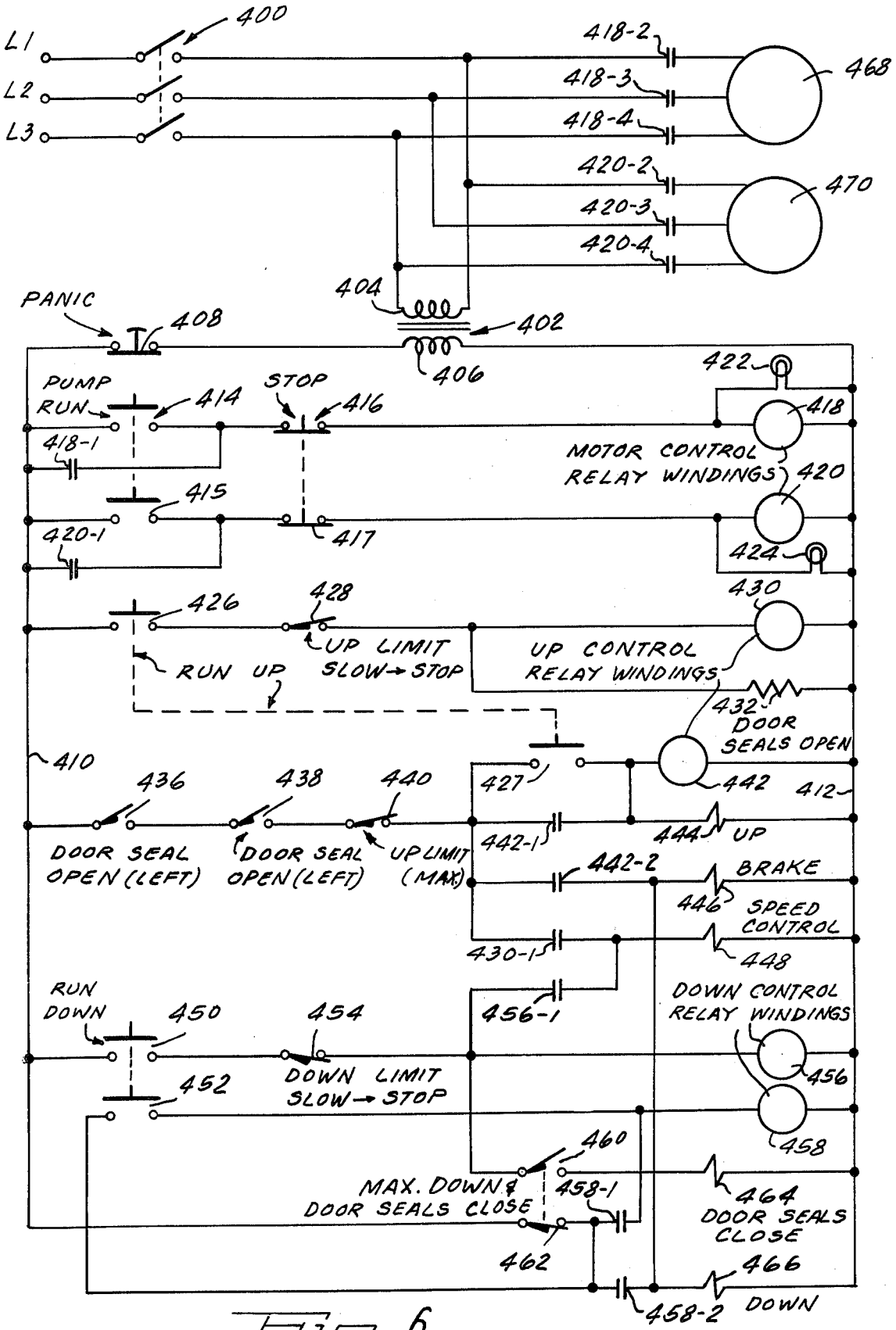
FIG. 6 is a schematic circuit diagram of a control circuit which may be employed in controlling operation of the apparatus illustrated in FIGS. 1–5.

Referring now to FIG. 6, a preferred circuit for controlling the operation of the apparatus of FIGS. 1–5 is illustrated. Although this circuit is not illustrated as comprising a remote station, the same could be provided in the same manner as the circuit illustrated in the above-mentioned copending application. In FIG. 6, a plurality of power terminals $L_1$, $L_2$, $L_3$ is provided for connection to a 3 $\phi$, 208 VAC, 60 Hz supply, which is fed to a primary winding 404 of a transformer 402 by way of a switch 400. The transformer 402 is a step-down transformer which provides an output voltage at the terminals of the secondary winding 406 of approximately 110 VAC. This potential is effective, via a panic button 408 across the bus conductors 410 and 412.

To start the circuit a pump run switch 414, 415 is operated to apply the bus voltage, via closed stop switches 416 and 417 to a pair of relay windings 418 and 420 which become energized. A pair of lamps 422 and 424, mounted on a control panel, indicate the application of energizing voltage to the relays 418 and 420. The relay 418 operates to close its holding contact 418-1 and a plurality of contacts 418-2, 418-3 and 418-4 to supply 3 $\phi$ voltage to the primary pump motor 468, for example a 10 HP motor, while the relay winding 420 closes its holding contact 420-1 and a plurality of contacts 420-2, 420-3 and 420-4 to supply 3 $\phi$ operating voltage to an auxiliary pump motor 470, for example a 1½ HP motor.

Up Operation

Assuming that the door is closed, and an operator wishes to open the door, the run up switch 426, 427 is operated. Closure of the contacts 426 extends an operating circuit, via a closed up limit switch 428 to a relay winding 430 which is in parallel with a door seal open solenoid 432. The relay winding 430 closes its contacts 430-1 which is ineffective at the moment until the door seals have opened to close the limit switches 436 and 438. Upon closure of the switches 436 and 438, the up limit switch 440 being closed, a circuit is established by way of the run up contacts 427 to the relay winding 442, and by way of the closed contacts 430-1 to the speed control solenoid 448. Operation of the relay winding 442 causes closure of the associated contacts 442-1 and 442-2 extending the operating circuit across the solenoids 444 and 446, the solenoid 444 being the up direction solenoid and the solenoid 446 being the brake solenoid. Therefore, the brake has hydraulic pressure applied thereto and is released and the associated hydraulic circuit begins to rotate the tube 30 so as to roll up the curtain 20. As the curtain reaches a first predetermined up limit, the switch 428 is opened to deenergize the relay winding 430 and open the contacts 430-1. Opening of the contacts 430-1 deenergizes the speed control solenoid 448 so as to slow the upward movement, as will be understood from the hydraulic circuit discussed below. When the tube 30 reaches its maximum upper limit, the limit swtich 440 is opened to open the circuit to the relay winding 442 and to the up solenoid 444 and the brake solenoid 446. The up direction of rotation is stopped and the brake has hydraulic pressure removed and is set to hold the door in the open position.

Down Operation

To close the door, the down run switch 450, 452 is operated. Closure of the contacts 450 provides an operating connection, via the down limit slow-stop swtich 454 to a relay winding 456 which is energized to close its contacts 456-1 and provide a circuit connection to the speed control solenoid 448. Closure of the contacts 452 extend an operating circuit from the bus conductor 410 to a relay winding 458 by way of the max. down limit switch 462. Energization of the relay winding 458 closes the associated contacts 458-1 and 458-2. Closure of the contacts 458-1 extends a holding circuit to the relay winding 458 and closure of the contacts 458-2 extends an operating circuit to the down direction solenoid 466 to cause rotation of the fluid motor 60 in a direction to lower the curtain. The same circuit is extended by way of the contacts 458-2 to the brake solenoid 446 to apply hydraulic pressure and release the brake.

The curtain is rolled down to a first predetermined point at which the limit switch 454 is operated to open the circuit to the down control relay 456, thereby causing an opening of the contact 456-1 and deenergization of the speed control solenoid 448 to slow the speed of rotation and hence slow down the tube. When the curtain reaches its maximum down position, the max down and door seal limit switches operate together opening the switch 462 to remove the energizing current from the relay winding 458 and from the down direction solenoid 466, and the contacts 460 close to extend an operating path to the door seal close solenoid 464. The door is now closed and the side seals have operated to press the side marginal edges of the curtain 20 against the pads 340 and 342 and the pad 60 against the top of the tube 30, at each end of the tube, to effect a hold-down clamping action of the tube against the botton seal 362.

It should be noted that the down control relay winding 458 is a slow-to-release relay which provides a time delay during which the down operation continues, while braking is prevented, so that the side seals and bottom seal and hold down apparatus can come into operation which will prevent excessive tension in the curtain should an upward rotational reaction of the tube occur before the tube is forced down by the hold-down and clamping apparatus.

Hydraulic Circuits

Figure 8:
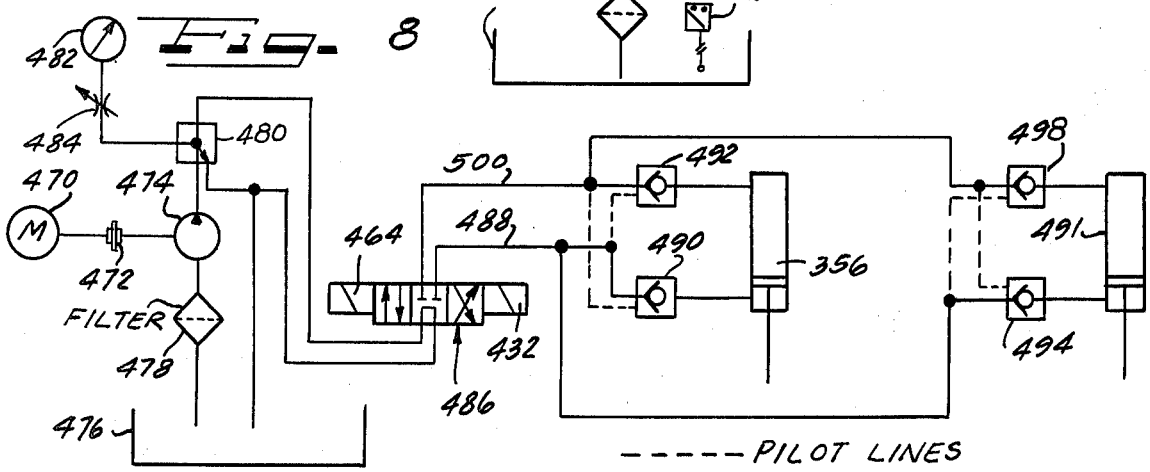
FIG. 8 is a hydraulic circuit diagram of a circuit for controlling the operation of the side seal mechanism.

Turning first to FIG. 8, the side seal hydraulic circuit is illustrated as comprising the auxiliary motor 470 which is coupled at 472 to a pump 474 which receives hydraulic fluid from a reservoir 476 through a filter 478. The pump 474 is connected back to the reservoir 476 by way of a relief valve 480 and a pressure gauge is connected to the relief valve 480 by way of a gauge shut off valve 484. When the seals are not being opened or closed, it is readily apparent that a fluid path is provided from the output of the pump 474 through the relief valve 480 and a directional valve 486 back to the reservoir 476. Upon operating the seal open solenoid 432, hydraulic fluid is delivered from the high pressure side of the pump 474 through an output conduit 488 to a check valve 490 and to one side of the hydraulic cylinder 356 causing the piston thereof to move in the direction to open the associated side seal, the opposite end of the cylinder 356 being relieved by the pilot operated check valve 492 for a return to the reservoir 476. The other side seal cylinder 491 (for the side seal at the opposite end of the door from that illustrated in FIG. 4). is connected in parallel with the cylinder 356 and operates in the same manner by way of the pilot operated check valves 491 and 498. To close the seals, the door seal close solenoid 464 is operated so as to supply pressure through the directional valve 486 and operate the cylinders 356, 491 with the output conduit 500 carrying high pressure fluid and the pilot operated check valves 492, 490, 498 and 494 operating in the opposite manner as they did in the up direction, this time fluid being returned to the reservoir by way of the conduit 488 and the directional control valve 486.

Figure 7:
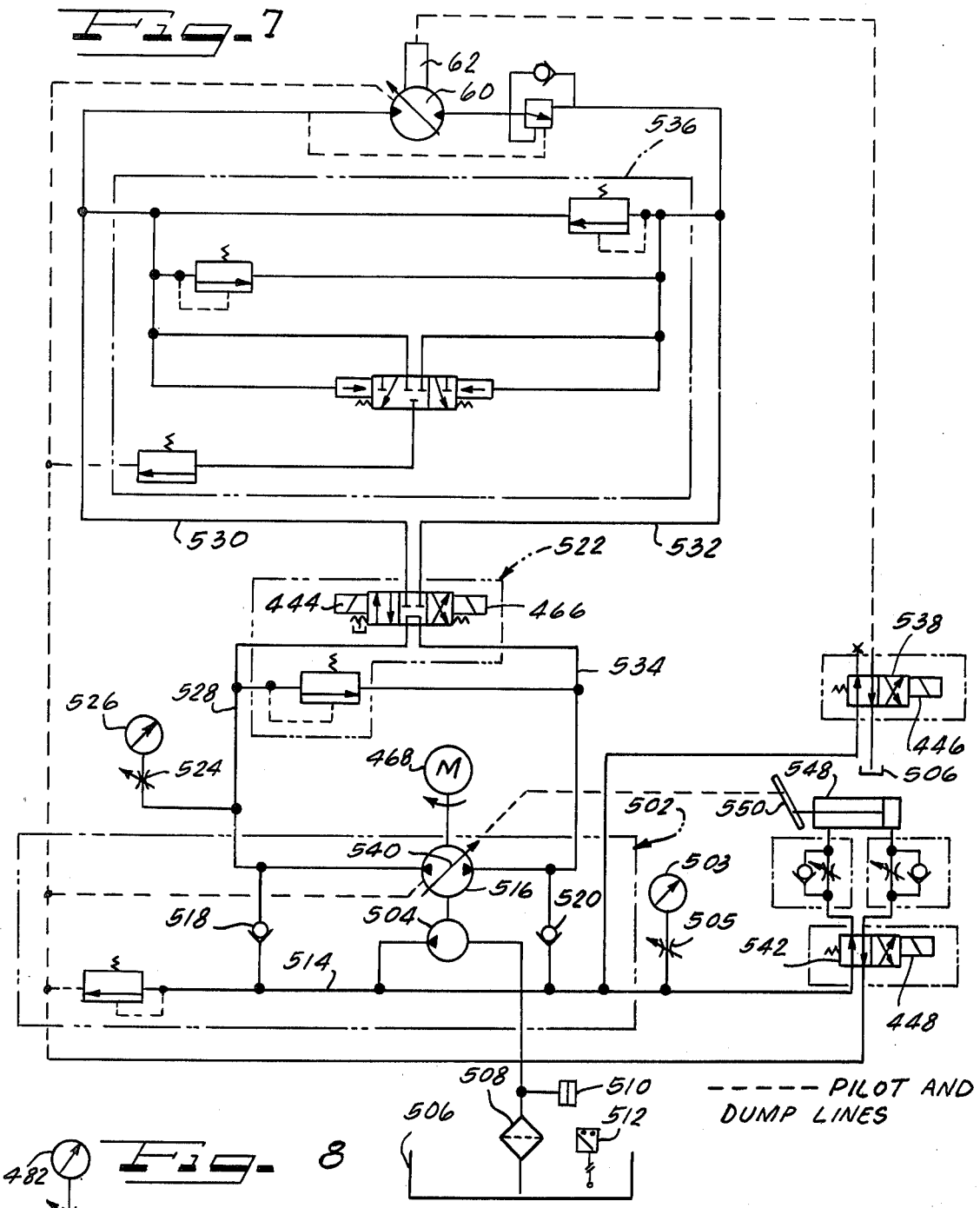
FIG. 7 is a hydraulic circuit diagram for use in connection with the electrical circuit diagram of FIG. 6.

FIG. 7 illustrates what we consider to be an improved version of the hydraulic circuit, namely that a swash plate pump is utilized for speed control and a cross over relief valve is employed to stabilize the circuit.

In FIG. 7, the motor 468 is employed to drive the swash plate pump apparatus 502. The particular swash plate pump employed herein includes a priming pump 504 which draws hydraulic fluid from a reservoir 506 through a filter 508 to charge a conduit 514 which functions as the actual fluid reservoir, additional fluid being provided by the priming pump 504 when necessary. The reservoir 506 is provided with a low level switch 2 to control the additional fluid when needed and a vacuum indicator 510. Inasmuch as the line 514 is considered to be the system reservoir, it will hereinafter be referred to as the reservoir line. The swash plate pump 502 includes a main pump 516 which receives hydraulic fluid from the pressurized reservoir line 514 by way of a pair of check valves 518, 520 and delivers fluid for operating the motor to a directional control valve 522 which includes the up and down operating solenoids 444 and 466. The swash plate pump 502 is also connected by way of a shut off valve 524 to a high pressure gauge 526.

It will be noted that the pump 516 is always connected in a complete fluid circuit from one side to the other side thereof. When there is no up or down operation, this fluid circuit extends through a shunt path in the directional control valve 522. During operation in either direction, this circuit extends twice through the directional control valve by way of the fluid motor 60.

To raise the tube and open the door, the solenoid 444 is operated which extends a fluid circuit to the motor 60 over the path including the conduit 528, the directional control valve 522, the conduit 530, the motor 60, the conduit 532, back to the directional valve 522 and back to the pump 516 by way of the conduit 534. To operate the tube in the down direction, the solenoid 466 is energized to reverse the aforementioned fluid path through the motor by creating a connection between the conduits 528 and 532 and between the conduits 530 and 534.

It should be noted that a cross over relief valve 536 is connected in shunt with the motor 60 and with the directional control valve 522 to relieve excessive pressures in either direction.

In either the up direction or the down direction, the brake solenoid 446 is operated to release the brake 462. Normally the brake 462 is connected through the brake valve 538 to the reservoir 506. Operation of the solenoid 446, however, connects the reservoir line 514 to the brake 62 to release the brake.

The swash plate pump, as well known in the art, includes a swash plate 540 which is movable to change the rate of delivery of the pump. This feature is used to slow the tube before it approaches the maximum up and down limits. Apparatus for effecting this operation includes a speed control valve 542 which is connected by way of a pair of flow control valves 544 and 546 to opposite ends of a hydraulic cylinder 548 which it has its extensible member connected to a lever 550, a pivotal lever, which is connected to the swash plate 540. Normally, the hydraulic circuit is in the condition illustrated so that the swash plate 540 is in a position to cause the fluid flow motor 60 to be driven at a first rate. Operation of the speed control solenoid 448, however, reverses the fluid connection to the cylinder 548 so as to move the lever 550 and the swash plate 540 to effect a second speed of rotation of the fluid motor 60. This second speed, according to the embodiment of the invention disclosed herein, is a higher speed and is effective throughout most of the upward or downward movement of the tube 30 until the up limit slow-stop switch 428 or the down limit slow-stop switch 454 is operated to release the energization of the speed control solenoid 448.

Again, in order to aid those skilled in the art in practicing the present invention, as exemplied in FIGS. 1, 6, 7 and 8, the major components of the system have been tabulated in the schedule below, other components of the system being readily apparent and readily available in the market place.

SCHEDULE OF COMPONENTS
(FIGS. 1, 6, 7 and 8)

| Ref. No(s). | Name | Manufacturer-Designation |
|---|---|---|
| 502,503,505,506 508,510,512,522, 536,542,544,546, 548,550 | Power Package | Fauver Series 18 |
| 468 | | Dayton 10 HP., 220 V, 3 $\phi$, 60 Hz No. ZN-986-K |
| 60 | Hydraulic Motor | CHAR-LYNN DCS |
| 62 | Hydraulic Brake | AUSCO 28653 |
| 64 | Torque Hub | FAIRFIELD 53A4-2-6-36 |
| 476 | Reservoir and Base | AA Circuit Pak |
| 478 | Suction Filter | MPF #SAF 59 G 10 |
| 470 | Electric Motor | 1½ HP |
| 472 | Pump Motor Coupling | |
| 474 | Pump | Fixed Volume Pump (Any Suitable Design) |
| 482 | High Pressure Gauge | 0-2000 psi, 2½" Dial, ¼" Connection |
| 484 | Shut Off Valve | Republic #135-1/4-B |
| 486 | Directional Control Valve | QF-005-TT-10A2-115V |
| 490,492,494, 498 | Pilot Operated Check Valve | Kepner 2710-P4 |
| 538 | Brake Control Valve | QJ-005-C-10A2 |
| 356,396 | Hydraulic Cylinder | PMC 9124 2½" × 24" |

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution of the art.

What is claimed is:

1. A closure apparatus for a vertical-opening defined by a header, a pair of spaced side walls and a floor, the side walls each having a marginal edge, said apparatus comprising:

a curtain including top, bottom and side marginal edges, said top marginal edge attached to the header and said side marginal edges overlapping respective ones of the marginal edges of the side walls;

an elongate tube having a longitudinal axis of rotation, said tube attached to said bottom marginal edge of said curtain;

vertical guide track means supported adjacent at least one of the side marginal edges of said curtain;

tube guide means engaging and movable along said vertical guide track means;

control means including motor means connected to said tube and to said tube guide means for rotating said tube in one direction to roll up said curtain and in the opposite direction to pay out said curtain; and side seal means including a pair of resilient members carried on respective ones of the marginal edges of the side walls and a pair of parallelogram structures disposed adjacent respective ones of the side walls, each of said parallelogram structures including a fixed member and a movable member parallel to and pivotally connected to said fixed member and movable to clamp the respective marginal edge of said curtain against the respective resilient member.

2. The closure apparatus of claim 1, wherein said side seal means includes a pair of rams each connected between a fixed member and a movable member of a respective parallelogram structure, said rams connected to and controlled by said control means to cause engagement and disengagement of said fixed members with said resilient members which are carried on the marginal edges of the side walls.

3. A side seal mechanism for clamping the side marginal edge of a flexible curtain against a side marginal edge of a doorway, comprising:

a fixed first member extending parallel to the side marginal edge of the doorway with the side marginal edge of the curtain therebetween;

a second member pivotally connected to and extending parallel to said first member; and operating means connected to said second member for pivoting the same toward the side marginal edges of the curtain and doorway, while maintaining the parallel relation of said members, to engage and clamp the side marginal edge of the curtain to the side marginal edge of the doorway.

4. The mechanism of claim 3, comprising:

a resilient sealing member carried by the side marginal edge of the doorway to receive the side marginal edge of the curtain.

5. A hold-down mechanism for clamping a tube having a doorway closing curtain connected thereto to a supporting surface, comprising:

a fixed first member extending parallel to the doorway and located adjacent a side marginal edge of the doorway adjacent an end of the tube;

a second member pivotally connected to said first member and always oriented generally perpendicular thereto; and operating means connected to said second member for pivoting the same against the top of the tube to clamp the tube to the supporting surface.

6. The mechanism of claim 5, comprising:

a resilient bottom seal mounted in the supporting surface along the length of the tube and receiving the tube in a clamped relation thereagainst.

7. The mechanism of claim 5, comprising:

a resilient pad carried on said second member to engage the tube.

8. The mechanism of claim 5, comprising:

a third member parallel to and pivotally connected to said first member to clamp the side marginal edge of the curtain to the side marginal edge of the doorway.

9. The mechanism of claim 8, wherein said third member, which is parallel to said first member, carries said second member thereon.

10. The mechanism of claim 9, comprising:

a resilient bottom seal mounted in the supporting surface along the length of the tube and receiving the tube in a clamped relation thereagainst; and a resilient pad carried on said second member to engage said tube opposite the engagement of said tube and said resilient bottom seal.

11. A side seal and hold-down mechanism for clamping the side marginal edges of a flexible curtain against the side marginal edges of a doorway and for clamping a tube carried by the curtain to a supporting surface, comprising:

a pair of resilient side sealing members carried by respective side marginal edges of the doorway to receive the side marginal edges of the curtain thereagainst;

a resilient bottom seal mounted in the supporting surface along the length of the tube for receiving the tube in a clamped relation thereagainst;

a pair of fixed first members extending parallel to respective side marginal edges of the doorway with the respective side marginal edges of the curtain therebetween;

a pair of second members pivotally connected to and extending parallel to respective ones of said first members;

a pair of third members carried by respective ones of said second members and always oriented generally perpendicular to the respective first members;

a pair of resilient pads carried by respective ones of said third members for engaging the tube; and operating means connected to said second members for pivoting said second members toward the side marginal edges of the curtain and the doorway, while maintaining the parallel relation of said first and second members, to engage and clamp the side marginal edges of the curtain to the resilient sealing members carried by the side marginal edges of the doorway, while at the same time carrying said third members to place the resilient pads in engagement against the top of the tube to clamp the tube to the resilient bottom seal mounted in the supporting surface.

* * * * *